US005971213A

United States Patent [19]

Lee

[11] Patent Number: 5,971,213

[45] Date of Patent: Oct. 26, 1999

[54] WATER DISPENSER FOR A REFRIGERATOR

[75] Inventor: Jae-Hee Lee, Seoul, Rep. of Korea

[73] Assignee: Daewoo Electronics Co., Ltd., Seoul, Rep. of Korea

[21] Appl. No.: 08/857,492

[22] Filed: May 16, 1997

[30] Foreign Application Priority Data

May 16, 1996 [KR] Rep. of Korea ..... 96-16496

[51] Int. Cl.[6] ..... B67D 5/62

[52] U.S. Cl. ..... 222/146.6; 62/3.64; 62/448; 62/465; 62/382

[58] Field of Search ..... 222/160, 146.6, 222/181.1–3; 62/3.64, 297, 331, 440, 448, 457.1, 457.9, 382, 465

[56] References Cited

U.S. PATENT DOCUMENTS

| | | | |
|---|---|---|---|
| 3,395,550 | 8/1968 | Dungan | 62/400 |
| 3,934,758 | 1/1976 | Kipp | 222/108 |
| 4,970,871 | 11/1990 | Rudick . | |
| 5,083,442 | 1/1992 | Vlock . | |
| 5,303,849 | 4/1994 | Credle . | |
| 5,603,203 | 2/1997 | Tsai | 62/390 |
| 5,737,932 | 4/1998 | Lee | 62/135 |

FOREIGN PATENT DOCUMENTS 5-133654 5/1993 Japan .

*Primary Examiner*—Andres Kashnikow
*Assistant Examiner*—David Deal
*Attorney, Agent, or Firm*—Pillsbury Madison & Sutro LLP

[57] ABSTRACT

The present invention relates to a water dispenser having a water supplying means provided in the outer of the door of the refrigerator for refilling the water tank when it is empty.

According to an embodiment of the present invention, it is provided that a water dispenser of the refrigerator, wherein the water tank of the water dispenser can be refilled by supplying water from the outside of the door of the refrigerator, comprising: a water supplying box built in the outer of the door of the refrigerator and located higher than said water tank of said water dispenser, further comprising guide grooves on the sidewalls of said water supplying box and a hole to allow the supplied water to flow into said water tank positioned below said water supplying box; an inlet hose for connecting said hole of said water supplying box to said water tank; and a water supplying drawer for insertion into said water supplying box whereby said water supplying drawer is made for sliding tightly, and which comprises a closing portion provided at the bottom of the rear end of said water supplying drawer for closing or opening said hole, and which further comprises guide protrusions provided on the sidewalls of said water supplying drawer for insertion into said guide grooves.

Using the present invention, a user can refill the water tank simply by pulling out the water supplying drawer and supplying water into it without opening the door when the water tank is empty. Therefore, the loss of cool air and resulting power consumption of the refrigerator due to opening of the refrigerator door can be reduced.

12 Claims, 5 Drawing Sheets

WATER DISPENSER FOR A REFRIGERATOR

BACKGROUND OF THE INVENTION

1. Field of the Invention

The present invention relates to a water dispenser mounted on the door of the refrigerator for dispensing chilled water or beverage at the outside of the refrigerator without opening the door.

More particularly, the invention related to a water dispenser having a water supply means provided in the door wall of the refrigerator for refilling the water tank when it is empty.

2. Description of the Related Art

The refrigerator is an appliance for keeping foods and beverage at low temperature. Normally, it is preferable that water or beverage should be kept at about 4° C. temperature. When user opens the door of the refrigerator to enjoy water or beverage kept inside, the cool air in the refrigerator escapes from the refrigerator. Then, the refrigerator needs to consume more electric power to lower the inside temperature again.

Therefore, in order to reduce the power consumption of the refrigerator, its door should be open as infrequently as possible. For this purpose, the refrigerator having a water dispenser disposed in the door of the refrigerator has recently been marketed.

FIG. 1 is a cross-sectional side elevational view showing the structure of a conventional water dispenser. The water dispenser 101 includes a water tank 111 provided inside of the refrigerator door 110, and a water discharging part 116 provided outside of the refrigerator door 110.

The water discharging part 116 has a cock 113 connected with the water tank 111 through a drain hose 112, an operating lever 114 for opening and closing the cock 113, and a water receiving tray 115 provided in opposite site of the cock 113.

For this type of water dispenser, in order to chill water or beverage, user opens the cap 117 of the water tank 111 and supplies the water tank 111 with water or beverage. After a few hours, water or beverage contained in the water tank 111 is chilled by cooling air circulated in the refrigerator. When user wants to drink chilled water or beverage, he does not need to open the door 110 of the refrigerator. He merely pushes the operating lever 114 of the water dispenser 101 toward "A" direction with a cup 118. Then, the cock 113 is opened by pushing the operating lever 114, and chilled water or beverage contained in the water tank 111 is discharged to the cup 118 through the drain hose 112. When the user removes the cup 118 and releases the operating lever 114, the operating lever 114 returns to its original position and the cock 113 is closed to stop the discharge of the chilled water or beverage.

According to the above conventional water dispenser, user does not have to open the door of the refrigerator to get chilled water or beverage. However, when the water tank is empty, user must open the door of the refrigerator to re-supply the water tank with water or beverage. In order to re-supply the water tank with water or beverage, user must open the door of the refrigerator and separate the water tank from the door of the refrigerator.

Consequently, a great quantity of cooling air in the refrigerator escapes from the refrigerator during the above process which results in a waste of electric power energy.

Another prior art example, U.S. Pat. No. 5,083,442, discloses a refrigerator with a water dispenser combined with a reverse osmosis water purification system so that purified water is available at an ice-maker and water tap forming part of the refrigerator. The prior art allows user to get cool water without opening the door of the refrigerator.

Also since city water is supplied directly to the tank, it is not necessary to open the door to re-supply the water tank with water or beverage which result in a great deal of power consumption. However, the structure of the system is very complicated, and thus the maintenance of the system become more difficult.

SUMMARY OF THE INVENTION

Therefore, the present invention is directed to a water dispenser having a water supply means provided in the door wall of the refrigerator whereby the water tank of the water dispenser can be easily refilled by supplying water from the outside of the refrigerator.

A water dispenser of the refrigerator wherein the water tank of the water dispenser can be refilled by supplying water from the outside of the door of the refrigerator, comprising: a water supply receptacle means which is built in the door wall of the refrigerator and is located higher than said water tank; a water flowing means for connecting said water supply receptacle means to said water tank; and a water supply guide means which is inserted into said water supply receptacle means for defining a water flowing line to facilitate the supplying of water from the outside of the door of the refrigerator.

Furthermore, the second object of the present invention is to provide a water dispenser of the refrigerator, wherein the water tank of the water dispenser can be refilled by supplying the water from the outside of the door of the refrigerator, comprising: a water supply box which is built in the door wall of the refrigerator and is located higher than said water tank of said water dispenser, and which further comprises guide grooves on the sidewalls of said water supply box and a hole to allow supplied water to flow to said water tank positioned below said water supply box; a hose for connecting said hole of said water supply box to said water tank; and a water supply drawer which is inserted slidably into said water supply box while maintaining a watertight condition, and which comprises a closing portion provided at the bottom of the rear end of said water supply drawer in order to open said hole and guide protrusions provided on the sidewalls of said water supply drawer to be inserted into said guide grooves.

BRIEF DESCRIPTION OF THE DRAWINGS

These and other features, aspects, and advantages of the present invention will become better understood with regard to the following description, appended claims, and accompanying drawings wherein:

DETAILED DESCRIPTION OF THE INVENTION

Now, the present invention will be described in detail with reference to the preferred embodiments illustrated in the accompanying drawings.

Figure 1:
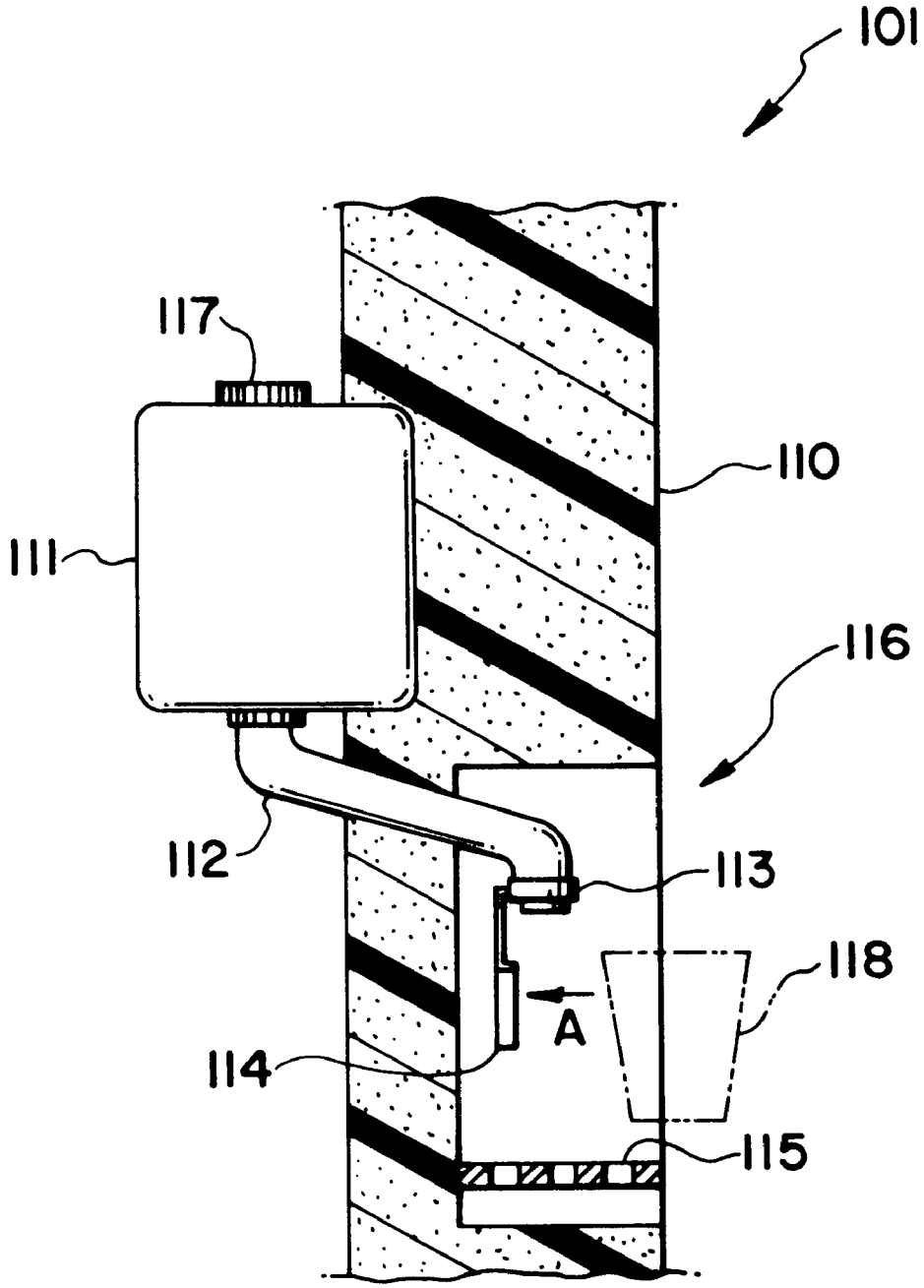
FIG. 1 is a cross-sectional side elevational view showing the structure of a conventional water dispenser.
Figure 2:
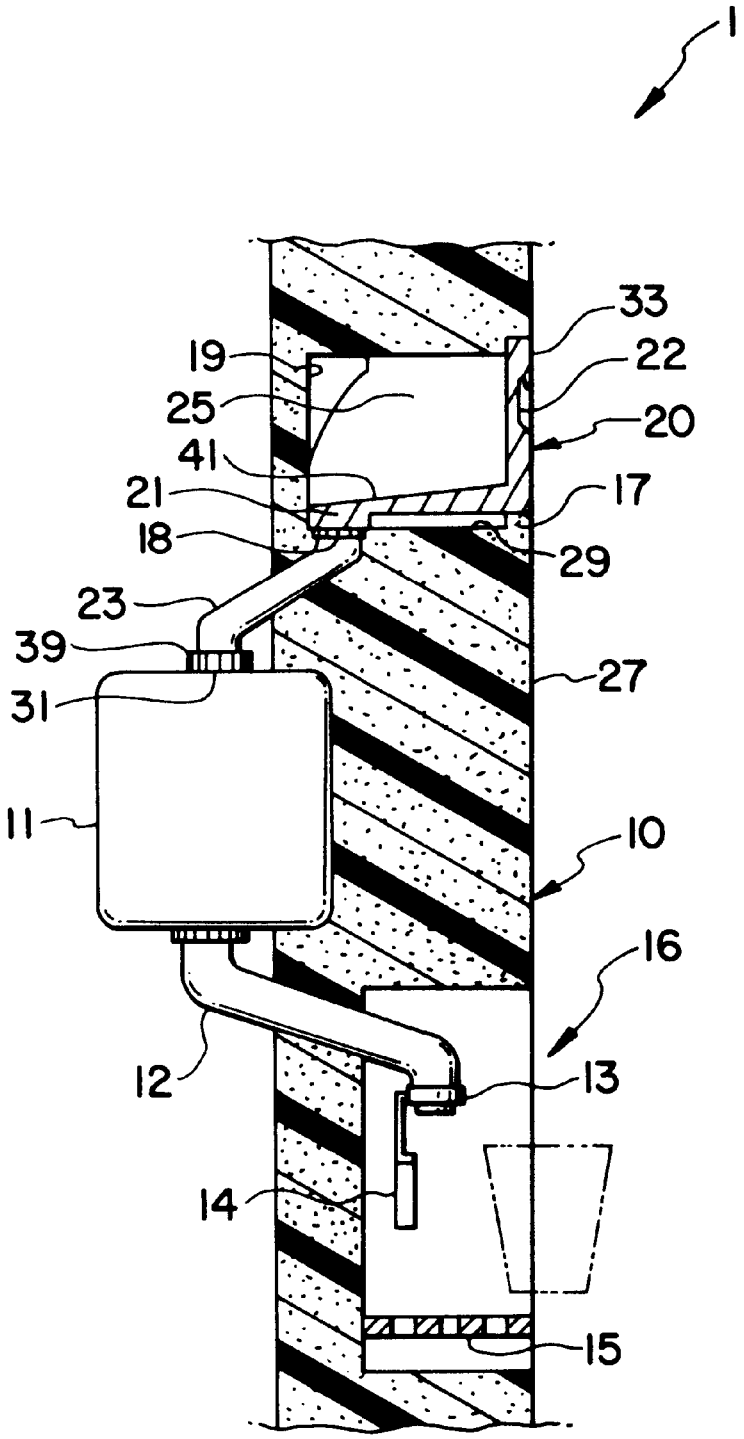
FIG. 2 is a cross-sectional side elevational view showing the structure of an embodiment of the water dispenser according to the invention.

FIG. 2 is a cross-sectional side elevational view showing the structure of a water dispenser according to an embodiment of the present invention. In FIG. 2, reference numeral 1 designates a water dispenser provided in the door 10 of the refrigerator. The water dispenser 1 includes a water tank 11 attached to the inside of the door 10 of the refrigerator and a water discharging part 16 recessed in outer wall 27 of the door 10 of the refrigerator.

The water discharging part 16 includes a cock 13 connected with the water tank 11 through a drain hose 12, an operating lever 14 for opening and closing the cock 13, and a water collecting tray 15 provided in the bottom of the water discharging part 16.

The water dispenser 1 according to an embodiment of the present invention includes a water supply box 19 built in the wall of the door 10, an inlet hose 23 which connects the water supply box 19 to the water tank 11, and a water supply drawer 20 inserted in the water supply box 19.

In order to facilitate the flow of water through the inlet hose 23, the water supply box 19 is located higher than the water tank 11. The water supply drawer 20 should be configured to allow for easy insertion and extraction from the water supply box 19.

The water supply box 19 has a space 25 wherein the water supply draw 20 is inserted. The space 25 may have five sidewalls(rear wall, top wall, bottom wall, right side wall, and left side wall). The water supply box 19 may have any shape depending on the shape of the water supply drawer 20 in order to allow for easy insertion and extraction thereto, e.g., a rectangular shape, a semi-circular shape, a trapezoidal shape and so forth.

Figure 4:
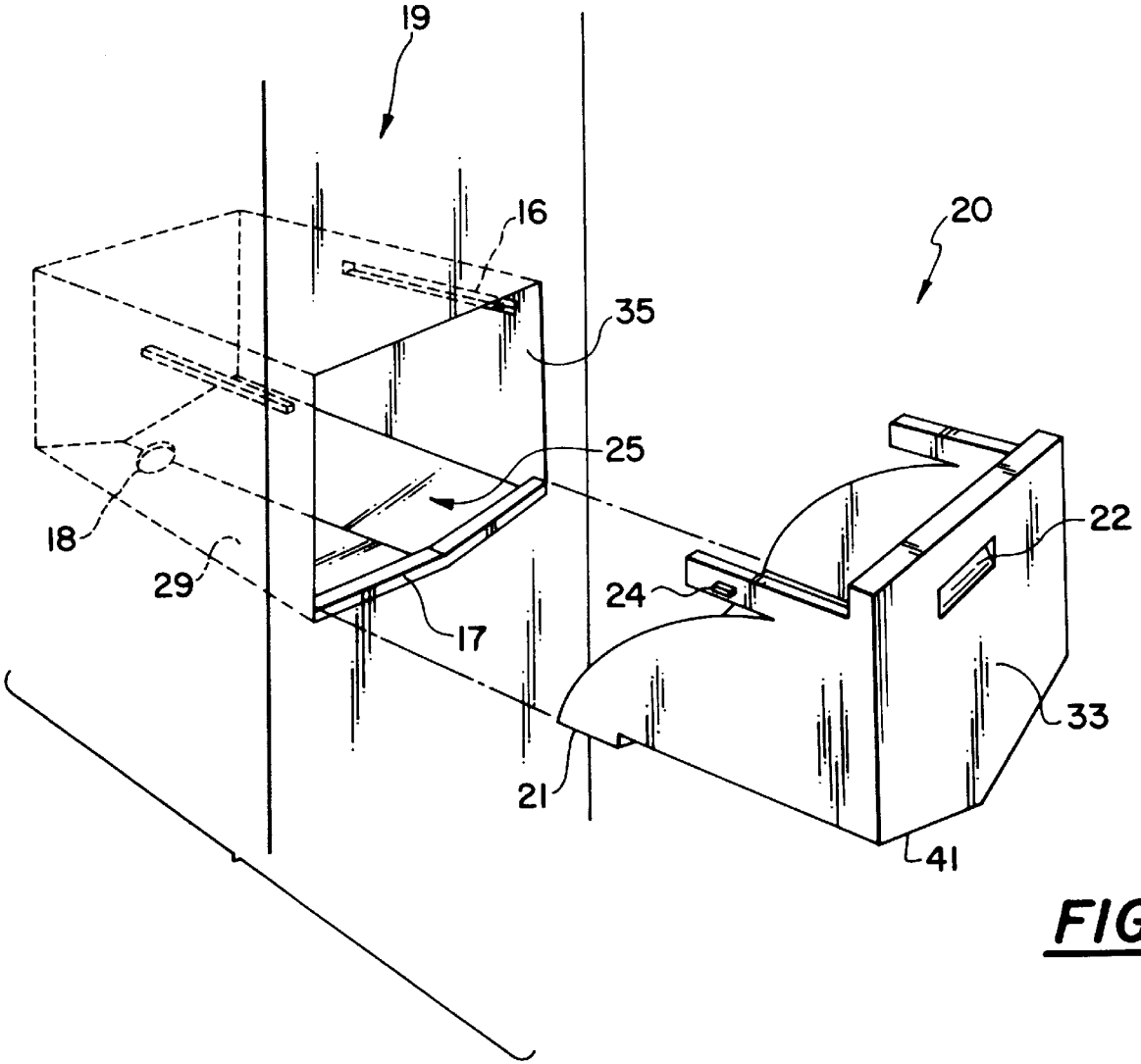
FIG. 4 is a perspective view showing the water supply drawer and the water supply box according to another embodiment of the invention.

FIG. 4 is a perspective view showing the insertion of the water supply drawer into the water supply box.

In FIG. 4, there is a hole 18 to which an inlet hose 23 is connected at the center of the bottom 29 of the water supply box 19. At the front edge of the bottom 29 of the water supply box 19, there is a projection 17 to prevent water overflow during water supply process when the water supply drawer 20 is pulled out and supplied with water by user.

To facilitate easy insertion of the water supply drawer 20 into the water supply box 19, guide grooves 26 are provided in parallel with the moving direction of the water supply drawer 20 on the sidewalls of the water supply box 19.

Figure 3:
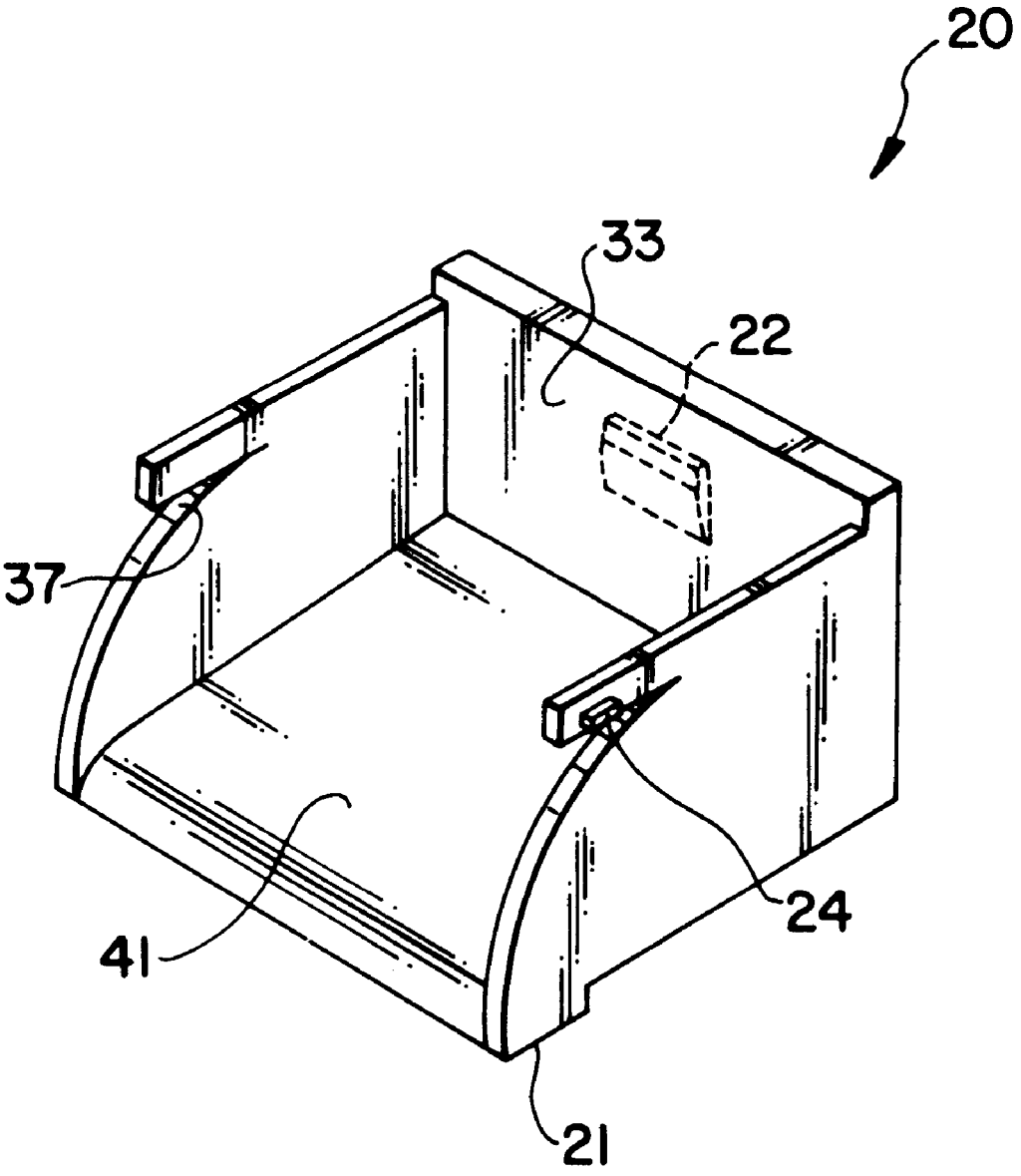
FIG. 3 is a perspective view showing the shape of the water supply drawer provided in the water dispenser according to an embodiment of the invention.

FIG. 3 is a perspective view showing the shape of the water supply drawer provided in the water dispenser according to an embodiment of the present invention. The water supply drawer 19 has two guide protrusions 24 provided on the sidewalls thereof.

The two guide protrusions 24 are inserted into the guide grooves 26 to make the water supply drawer 20 easily and stably inserted and extracted from the water supply box 19.

In order to facilitate the flow of supplied water through the hole 18, the top and rear side of the water supply drawer 20 are left exposed without sidewalls.

Furthermore, the water supply drawer 20 has the shape corresponding to that of the water supply box 19. A knob 22 on the front sidewall 33 of the water supply drawer 20 makes water supply drawer 20 to be pulled out easily.

A closing portion 21 is provided at the bottom of the rear end of the water supply drawer 20 for closing of the hole 18 to prevent leakage of cooling air from the refrigerator through the inlet hose 23. The closing portion 21 protrudes downward so that when user pulls out the water supply drawer 20 the closing portion 21 is caught by the projection 17, preventing the water supply drawer 20 from being pulled out completely.

According to an embodiment of the water supply drawer 20, cut-off parts 37 are provided on the sidewalls of the water supply drawer 20 below the guide protrusions 24. The cut-off parts 37 provides the guide protrusions 24 with horizontal elasticity which allows for easy insertion of the water supply drawer 20 into the water supply box 19 as well as easy separation of the water supply drawer 20 from the water supply box 19.

As illustrated in FIG. 2, the bottom of the water supply drawer 20 is inclined in such a manner that the rear part of the bottom is lower than the front part of the bottom in order to allow water to flow downward into the hole 18.

According to another embodiment of the present invention illustrated in FIG. 4, both the bottom 29 of the water supply box 19 and the bottom 41 of the water supply drawer 20 have the shape of "V" to maximize water flow rate to the hole 18 and minimize water residue on the bottom.

The inlet hose 23 positioned between the water supply box 19 and the water tank 11 is connected to the inlet hole 31 of the water tank 11. In an embodiment of the present invention, the inlet hose 23 is connected to the inlet hole 31 by a sealing cap 39, and the inlet hose 23 is made separable from the inlet hole.

The operating mechanism of the water dispenser above is described hereinafter.

Figure 5:
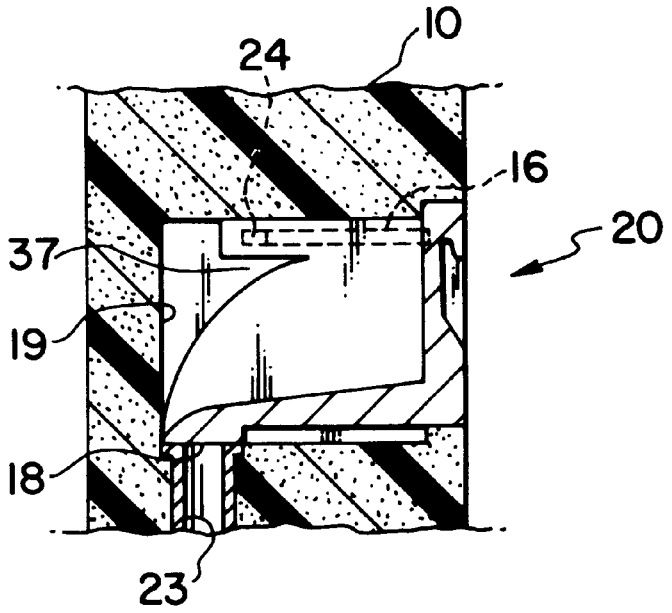
FIG. 5 is a cross-sectional side elevational view showing the water supply drawer inserted into the water supply box.

Normally, as illustrated in FIG. 5, the water supply drawer 20 is inserted into the water supply box 19. At this position, the closing portion 21 provided on the bottom of the water supply drawer 20 closes the hole 18 to prevent leakage of cooling air from the inside of the refrigerator.

When the water tank 11 becomes empty, user can refill it with water using the water supply drawer 20 and the water supply box 19 without opening the door of the refrigerator.

Figure 6:
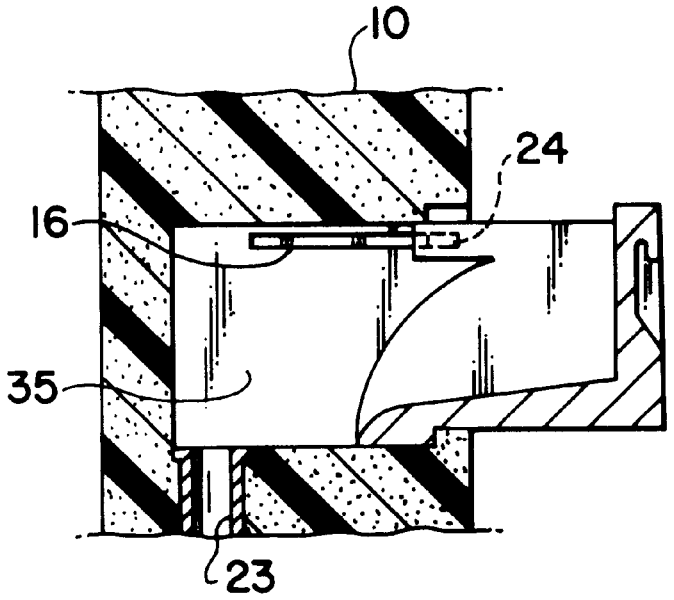
FIG. 6 is a cross-sectional side elevational view showing the water supply drawer pulled out from the water supply box.

First, user pulls out the water supply drawer 20 by the knob 22. Then, the guide protrusions 24 provided on the sidewalls of the water supply drawer 20 are guided out by the guide grooves 26 provided on the sidewalls 35 of the water supply drawer 20 is pulled out from the water supply box 19 as illustrated in FIG. 6.

The closing part 21 which is protruding downward from the water supply drawer 20 is caught by the projection 17 of the water supply box 20 and the guide protrusions 24 are also caught by the end of the guide grooves 26 so that the water supply drawer 20 is prevented from being pulled out completely.

In this situation, user may supply water to the opened water supply box 19. The supplied water flows down the inclined bottom of the water supply drawer 20, into the hole 18, through the inlet hose 23, and finally into the water tank 11.

As illustrated in FIG. 4, both the bottom 29 of the water supply box 19 and the bottom 41 of the water supply drawer 20 are shape like "V" so that the supplied water flow easily into the hole 18 with minimum of water residue on the bottom.

Furthermore, because the closing part 21 of the water supply drawer 20 is protruding downward and is caught by the projection 17 of the water supply box 20, the overflow of water is prevented.

After the water tank has been refilled, user pushes the water supply drawer 20 into the water supply box 19, whereupon the guide protrusions 24 are guided in by the guide grooves 26. The water supply drawer 20 is returned to its original position as illustrated in FIG. 5.

When the water supply drawer 20 is inserted into the water supply box 19, the closing portion 21 provided in the bottom of the water supply drawer 20 closes the hole 18 to prevent leakage of cooling air from the inside of the refrigerator.

The cut-off parts 37 are provided on the sidewalls of the water supply drawer 20 below the guide protrusions 24 to make the guide protrusions 24 elastic in a horizontal direction. This allows for easy insertion of the water supply drawer 20 into the water supply box 19 and easy separation of the water supply drawer 20 from the water supply box 19, as well as facilitating the contact of the two guide protrusions 24 with the guide grooves 26.

As embodiment of the present invention allows for easy separation of the water supply drawer 20 from the water supply box 19 so that user can easily clean and sterilize the water supply drawer 20.

Furthermore, the engagement between the inlet hose 23 and the water tank 11 can be disengaged with the sealing cap 39, thereby to allow for user to detach the water tank from the door and to clean it.

As described above, according to an embodiment of the present invention, user can refill the water tank simply by pulling out the water supply drawer which is provided above the water dispenser in the door and supply water to the water supply drawer without opening the door when the water tank is empty.

Therefore, the loss of cooling air and resulting increase in power consumption of the refrigerator due to opening of the refrigerator door can be reduced. Furthermore, the structure of the water supply means according to an embodiment of the present invention is very simple so that maintenance and use of the water supply means are very easy.

The foregoing disclosure and drawings are merely illustrative of the principle of the present invention and are not to be interpreted in a limiting sense. The only limitation is to be determined from the scope of the appended claims.

We claim:

1. A water dispenser of the refrigerator, wherein a water tank of the water dispenser can be refilled by supplying water from the outside of the door of the refrigerator, comprising:

a water supply receptacle means which is built in the door wall of the refrigerator and is located higher than said water tank of said water dispenser;

a water flowing means for connecting said water supply receptacle means to said water tank; and a water supply guide means which is inserted into said water supply receptacle means to define water flowing line from the outside of the door of the refrigerator to said water flowing means.

2. A water dispenser of the refrigerator according to claim 1, wherein said water supply receptacle means is a water supply box which is recessed in the door wall of the refrigerator to provide a space where said water supply guide means can be inserted, and the bottom of said water supply box has a hole connected to said water flowing means.

3. A water dispenser of the refrigerator according to claim 1, wherein said water supply guide means is a water supply drawer with its top and rear sidewalls left exposed, and said water supply drawer has a shape corresponding with the shape of said water supply box and comprises a knob on the front sidewall for pulling it out of said water supply box.

4. A water dispenser of the refrigerator according to claim 2 or 3, comprises a closing portion for closing said hole on said water supply box to prevent leakage of cooling air of the refrigerator at the bottom of said water supply drawer.

5. A water dispenser of the refrigerator according to claim 2 or 3, wherein said water supply box has a projection at the front edge of the bottom side, thereby to catch said closing portion of said water supply drawer for preventing said water supply drawer from being pulled out completely by accident from said water supply box.

6. A water dispenser of the refrigerator according to claim 2 or 3, wherein said water supply box further comprises guide grooves on the sidewalls of said water supply box in parallel with the moving direction of said water supply drawer further comprises guide protrusions on its sidewalls inserted into said guide grooves to guide the movement of said water supply drawer.

7. A water dispenser of the refrigerator according to claim 6, wherein cut-off parts are provided on the sidewalls of said water supply drawer below said guide protrusions to give said guide protrusions a horizontal elasticity.

8. A water dispenser of the refrigerator according to claim 2 or 3, wherein both the bottom of said water supply box and the bottom of said water supply drawer have "V" shape.

9. A water dispenser of the refrigerator according to claim 3, wherein the bottom of said water supply drawer is slope down toward the rear part thereof.

10. A water dispenser of the refrigerator according to claim 1, wherein said water flowing means is an inlet hose one end of which is watertightly connected to said hole of said water supply box and the other end of which is connected to the opening of said water tank.

11. A water dispenser of the refrigerator according to claim 10, wherein the engagement between said inlet hose and said water tank is disengaged with the sealing cap.

12. A water dispenser of the refrigerator, wherein a water tank of the water dispenser can be refilled by supplying water from the outside of the door of the refrigerator, comprising:

a water supply box which is built in the door wall of the refrigerator and is located higher than said water tank of said water dispenser, and which comprises guide grooves on its sidewalls and a hole on its bottom to allow the supplied water to flow into said water tank positioned below said water supply box;

an inlet hose for connecting said hole of said water supply box to said water tank; and a water supply drawer inserted slidably into said water supply box while maintaining watertight condition, and which comprises a closing portion provided at the bottom of said water supply drawer in order to close or open said hole and guide protrusions provided on the sidewalls of said water supply drawer to be inserted into said guide groove.

* * * * *